US012173562B2

(12) United States Patent
Marbach et al.

(10) Patent No.: US 12,173,562 B2
(45) Date of Patent: Dec. 24, 2024

(54) WELLHEAD ELECTRICAL FEED-THRU PENETRATOR WITH SEALING, BREAKAWAY APPARATUS AND METHOD OF INSTALLATION

(71) Applicant: POWER FEED-THRU SYSTEMS AND CONNECTORS LLC, Deer Park, TX (US)

(72) Inventors: Brandon Marbach, Spring, TX (US); Roy Kinkaid, Humble, TX (US); James Patrick Payne, League City, TX (US); Albert George Ollre, V, Houston, TX (US)

(73) Assignee: POWER FEED-THRU SYSTEMS AND CONNECTORS LLC, Deer Park, TX (US)

( * ) Notice: Subject to any disclaimer, the term of this patent is extended or adjusted under 35 U.S.C. 154(b) by 199 days.

(21) Appl. No.: 17/658,555

(22) Filed: Apr. 8, 2022

(65) Prior Publication Data

US 2023/0265722 A1 Aug. 24, 2023

Related U.S. Application Data

(63) Continuation-in-part of application No. 17/652,379, filed on Feb. 24, 2022.

(51) Int. Cl.
*E21B 17/02* (2006.01)
*E21B 33/04* (2006.01)

(52) U.S. Cl.
CPC ..... *E21B 17/028* (2013.01); *E21B 33/0407* (2013.01)

(58) Field of Classification Search
CPC ..... E21B 17/028; E21B 33/0407
See application file for complete search history.

(56) References Cited

U.S. PATENT DOCUMENTS

| | | | | |
|---|---|---|---|---|
| 6,688,386 | B2 * | 2/2004 | Cornelssen | E21B 33/0407 166/97.5 |
| 10,280,701 | B2 * | 5/2019 | Emerson | E21B 33/0355 |
| 10,760,350 | B2 * | 9/2020 | Anderson | E21B 43/128 |
| 10,871,040 | B2 * | 12/2020 | Ames | E21B 17/0285 |
| 11,070,043 | B1 * | 7/2021 | Marbach | H02G 15/115 |
| 2022/0106840 | A1 * | 4/2022 | Firth | E21B 33/068 |

* cited by examiner

*Primary Examiner* — Nicole Coy
(74) *Attorney, Agent, or Firm* — Alexander B. Uber; Gray Reed

(57) ABSTRACT

An improved wellhead electrical connection assembly utilizing upper and lower retention mechanisms to minimize pressure and fluid leakage in the event of a tubing part or other failure. The upper retention mechanism ensures the connection assembly remains within a tubing hanger. The lower retention mechanism provides a secure connection to a downhole cable that can breakaway without damaging or dislodging other components of the assembly during an emergency event.

7 Claims, 16 Drawing Sheets

500
310

302
215
211
212
223

WELLHEAD ELECTRICAL FEED-THRU PENETRATOR WITH SEALING, BREAKAWAY APPARATUS AND METHOD OF INSTALLATION

CITATION TO PRIOR APPLICATIONS

The present application is a Continuation-In-Part of and claims priority to U.S. Nonprovisional application Ser. No. 17/652,379, titled "WELLHEAD ELECTRICAL FEED-THRU PENETRATOR WITH SEALING, BREAKAWAY APPARATUS AND METHOD OF INSTALLATION" and filed on or about Feb. 24, 2022.

BACKGROUND AND SUMMARY

Wellhead penetrators are purposed to allow electrical power to be delivered down a well from a surface source. As a result, wellhead penetrators play an integral role in many wellhead operations. Consistent with other wellhead components and structures, a wellhead penetrator can sometimes become exposed to the high-pressure environment that arises within a producing well. Accordingly, conventional wellhead penetrators attempt to incorporate design elements directed at safely responding to such pressures in the event of some downhole failure or other emergency scenario. These conventional safeguards, however, often allow high pressure to extend up through to the wellhead and can come at the cost of other wellhead components that may become lost or otherwise destroyed during a break in some tubing connection.

For example, in some conventional designs, a wellhead penetrator assembly permits a cable from an electric submersible pump (ESP) to pass through the wellhead. In the event of a downhole failure, wellbore fluids could migrate through the wellhead ultimately reaching the outer barrier that facilitated the connection between the ESP cable and apparatus external to the wellhead. This is an undesirable situation as the well would require substantial workover activities, and the pressurized wellbore fluids would need to be safely handled to avoid injury and/or environmental exposure to harmful fluids. The only practical method to minimize the potential effects of the pressurized cavity and environmental damage would be to "kill" the well with kill fluids that would balance out the pressure differential. It is an object of the present disclosure to avoid this situation. Rather than having an ESP cable pass through the wellhead, the ESP connection terminates in the tubing hanger. This approach eliminates the need for a separable connection outside the wellhead and any gas buildup would occur lower within the well.

In other conventional designs, a power cable originating from the surface and passed through the wellhead will extend alongside the production tubing and connect to an ESP (or other, similar technology) that is itself connected to the bottom end of a tubing string. Wellhead penetrator assemblies of this design often focus on the seal made against the surface-originating power cable as it is passed through the wellhead. During a tubing part or other failure, shifting downhole components may put the ESP cable in tension and apply thousands of pounds of force along the connection. As with the previously discussed convention design, this is an undesirable situation as such force may disrupt the seal made against the surface-originating power cable and could ultimately allow wellbore fluids to reach the outer atmosphere. It is also an object of the present disclosure to avoid this scenario.

A penetrator assembly in accordance with the present disclosure creates an improved sealed connection between a surface-originating power cable and an ESP (or other similar technology) cable by providing a secure retention mechanism that allows for the downhole portion of the connection to disengage with the assembly during a tubing part or other failure. Even during such a failure, the presently disclosed penetrator assembly maintains its seal integrity thereby preventing pressure buildup in the wellhead as well as the exposure of any wellbore fluids to the outer atmosphere.

DETAILED DESCRIPTION

This description, with references to the figures, presents non-limiting examples of embodiments of the present disclosure.

Embodiments of this disclosure relate generally to an improved wellhead electrical connection assembly that may be used, for example, in oil and gas operations. Some embodiments of such an improved wellhead electrical connection assembly include a penetrator assembly.

Figure 1:
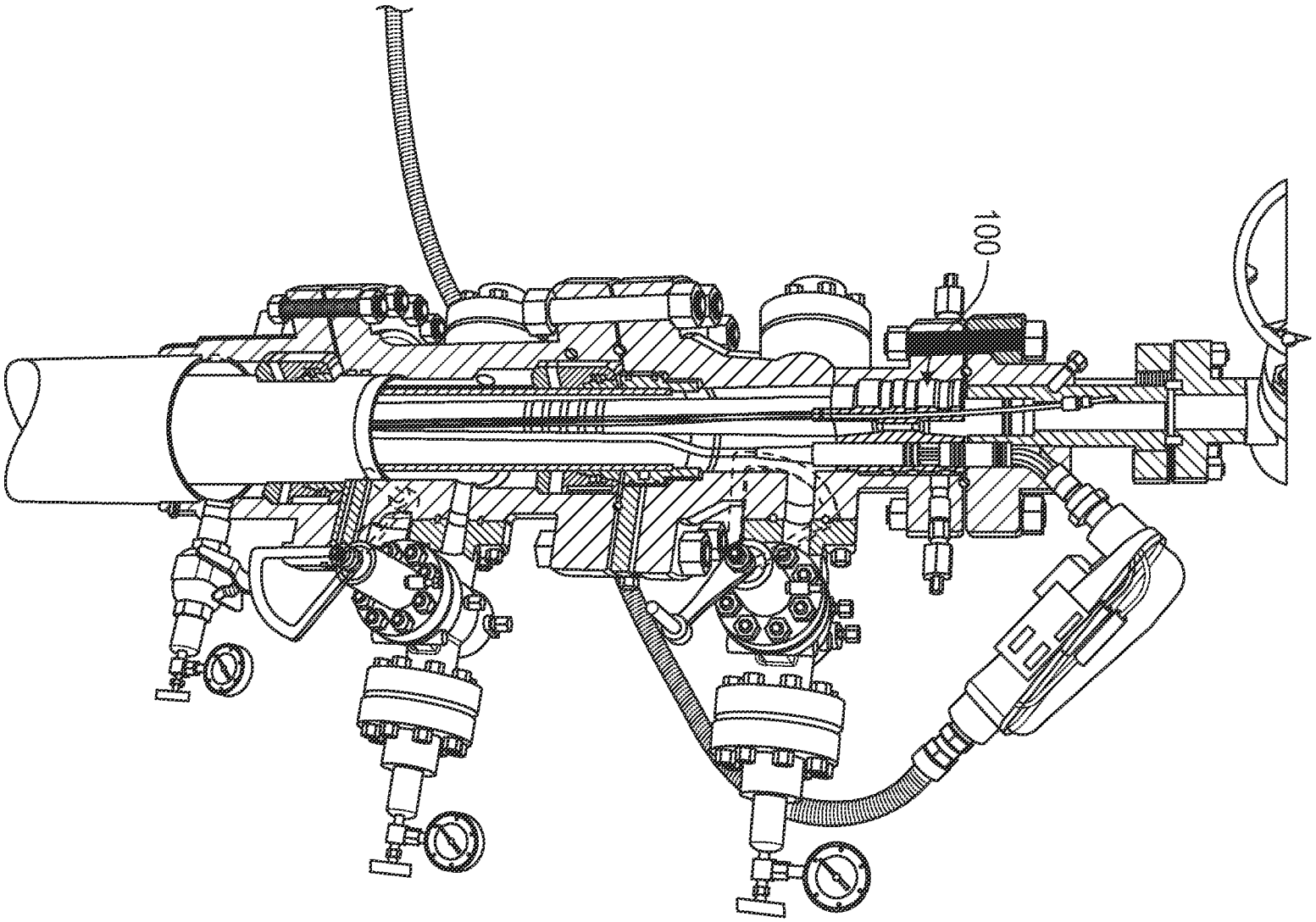
FIG. 1 (Prior Art)
FIG. 1 depicts a cutaway, perspective view of conventional wellhead assembly including a tubing hanger.
Figure 2B:
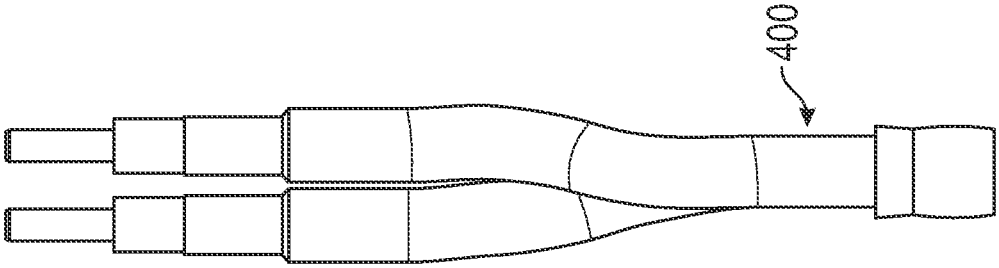
FIG. 2B depicts a side view of an ESP cable that has been prepared to engage with a penetrator assembly.
Figure 2A:
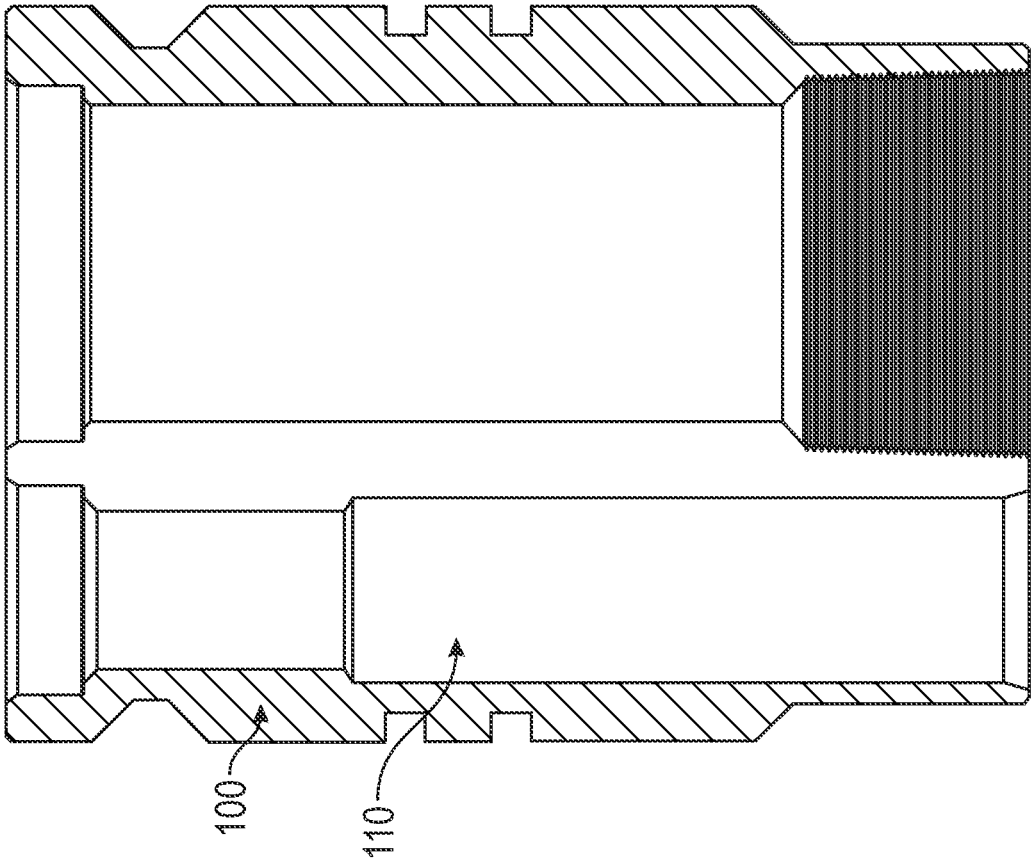
FIG. 2A depicts a cutaway view of a conventional tubing hanger with a penetrator assembly profile.
Figure 3:
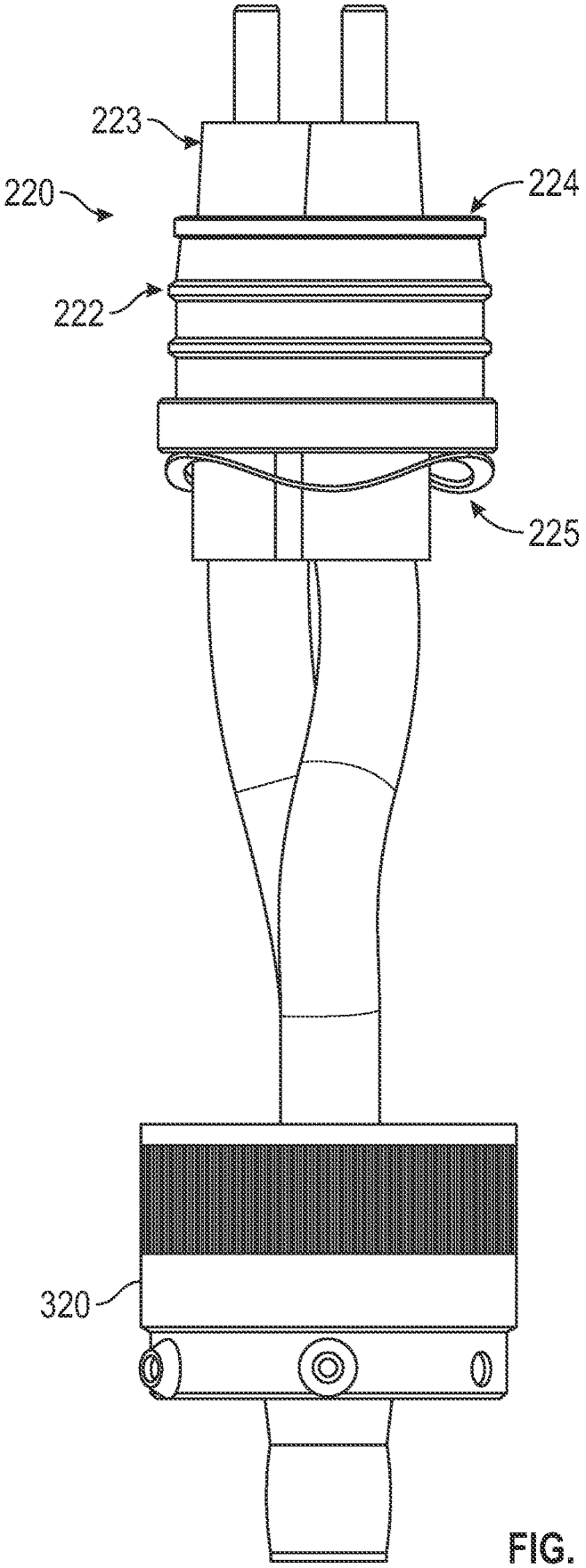
FIG. 3 depicts a side view of an ESP cable prepared in accordance with various embodiments of the present disclosure.
Figure 4:
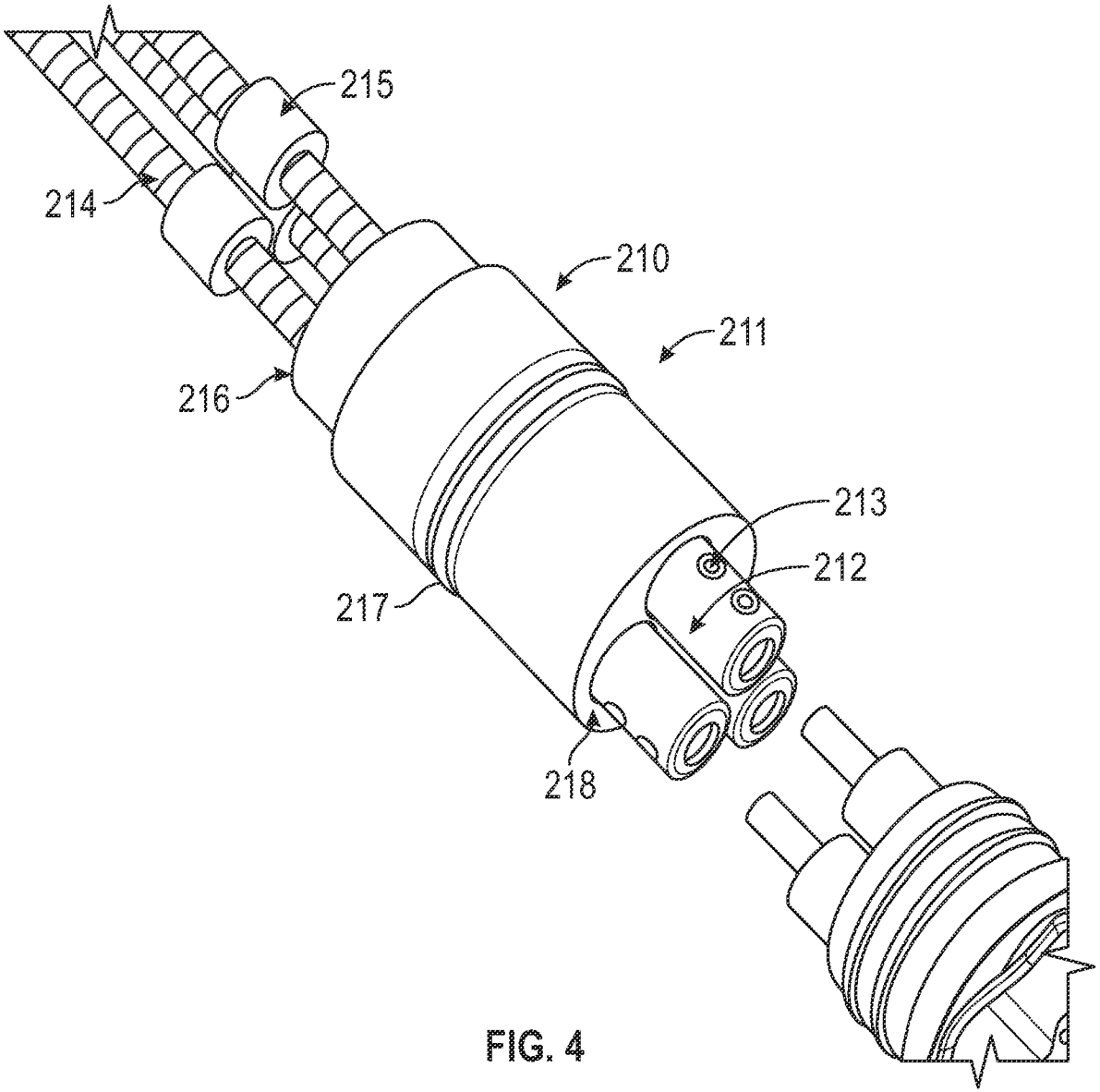
FIG. 4 depicts a perspective view of an upper penetrator assembly and a lower penetrator assembly in accordance with various embodiments of the present disclosure.
Figure 5:
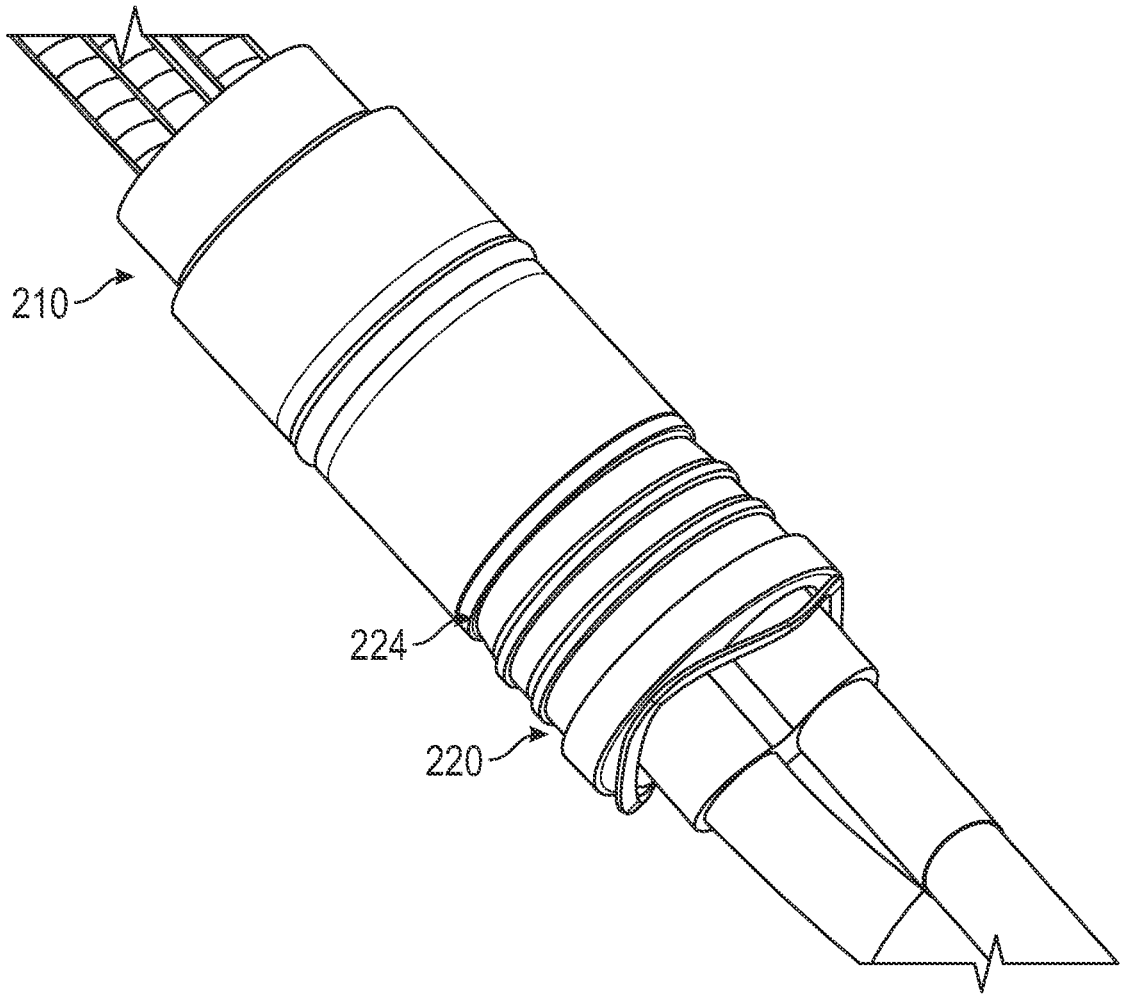
FIG. 5 depicts a perspective view of a combined upper penetrator assembly and lower penetrator assembly in accordance with various embodiments of the present disclosure.
Figure 6B:
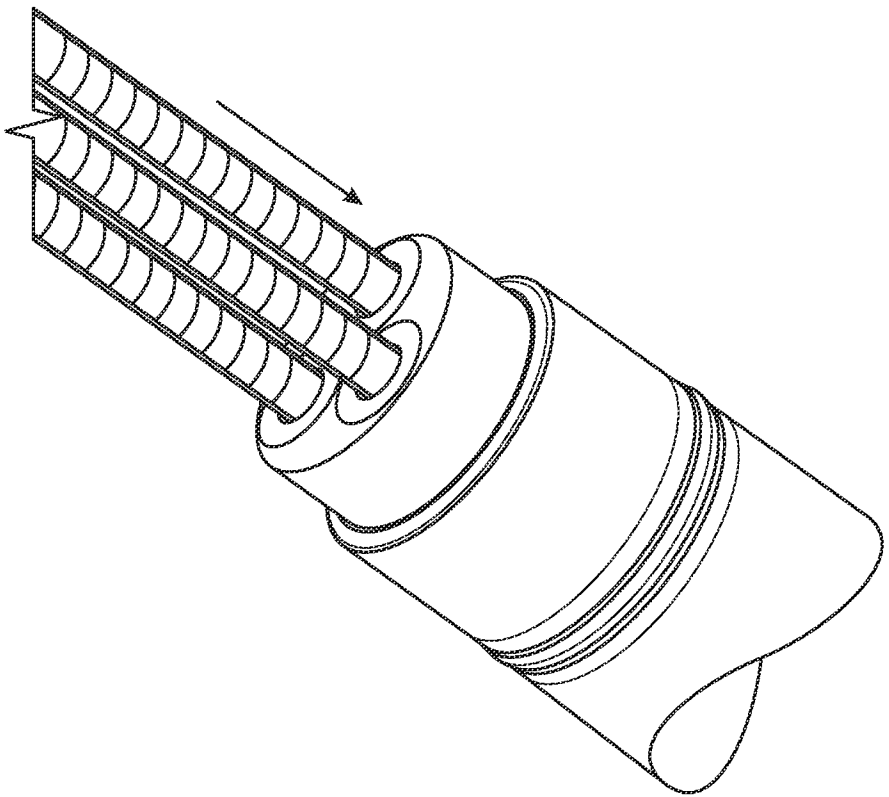
FIG. 6B depicts a perspective view of an upper penetrator nose sealing element in accordance with various embodiments of the present disclosure.
Figure 6A:
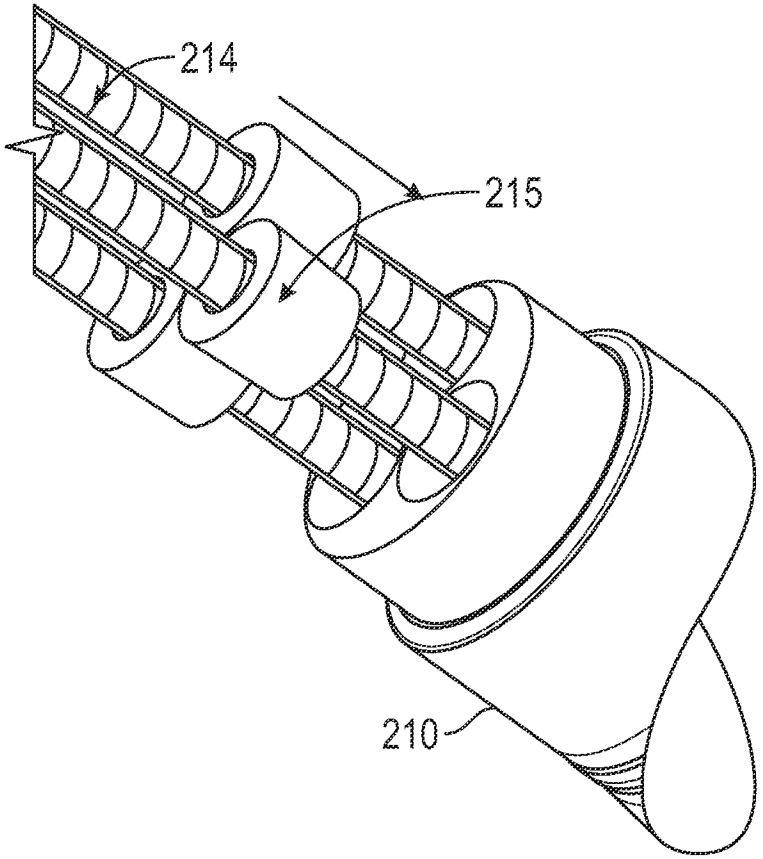
FIG. 6A depicts a perspective view of an upper penetrator nose sealing element in accordance with various embodiments of the present disclosure.

As shown in FIG. 1, conventional approaches often utilize a tubing hanger 100 having a penetrator assembly disposed therein. These penetrator assemblies are used to facilitate a connection between an external power source and downhole apparatus, such as ESPs. Tubing hangers are often configured to receive a penetrator assembly in a designated volume 110 within the tubing hanger as seen in FIG. 2.

In certain embodiments of the present disclosure, as illustrated in FIGS. 3-7, penetrator assembly 200 may have an upper assembly 210 and a lower assembly 220. Upper assembly 210 may include an upper body 211 and at least one conductor receiver 212. Upper body 211 may be substantially formed of polyetheretherketone (PEEK) or other suitable insulating material. Upper body 211 may be configured with a first upper groove on an upper body exterior face to receive a first outer sealing element 217. First outer sealing element 217 may be an elastomeric O-ring. First outer sealing element 217 is configured to minimize any potential fluid flow beyond its position on the exterior surface of upper body 211. Each of the at least one conductor receiver 212 may include a conductor retention element 213. Each of the at least one conductor receiver 212 may be a copper lug. Each of the at least one conductor receiver 212 may be configured with a first female end and a second female end positioned opposite one another wherein the first and second female end are each configured to receive a conductor. Conductor retention element 213 may be at least one set screw which may be tightened to securely retain any conductor that is received within the conductor receiver 212. Set screws may be flat-faced for improved performance. Those of ordinary skill in the art would appreciate that alternative retention elements, such as a simple plug/socket design, would provide for a similar retention and release mechanism (though at a substantially lower tensile force). Upper assembly 210 may be configured to receive at least one external power cable 214. At least one nose sealing element 215 may also be included in upper assembly 210. A small amount of dielectric grease may be applied to each of at least one nose sealing element 215 to allow each of at least one nose sealing element 215 to slide down each of at least one external power cable 214 and into upper body 211 until each of at least one nose sealing element 215 is substantially flush with an upper face 216 of upper body 211. Lower assembly 220 may include a primary lower sealing element 222, at least one secondary lower sealing element 223, and a follower 224. Follower 224 may be substantially formed of PEEK or other suitable insulating material. Lower assembly 220 is configured to be installed at least one ESP cable 400. Each conductor of each of at least one ESP cable 400 may be passed through primary lower sealing element 222. Each conductor of each of at least one ESP cable 400 may pass through one of said at least one secondary lower sealing element 223. Follower 224 may be passed over at least one secondary lower sealing element 223. Lower assembly 220 may further include a spring element 225. Spring element 225 may be a wave spring.

Figures 12A, 12B:
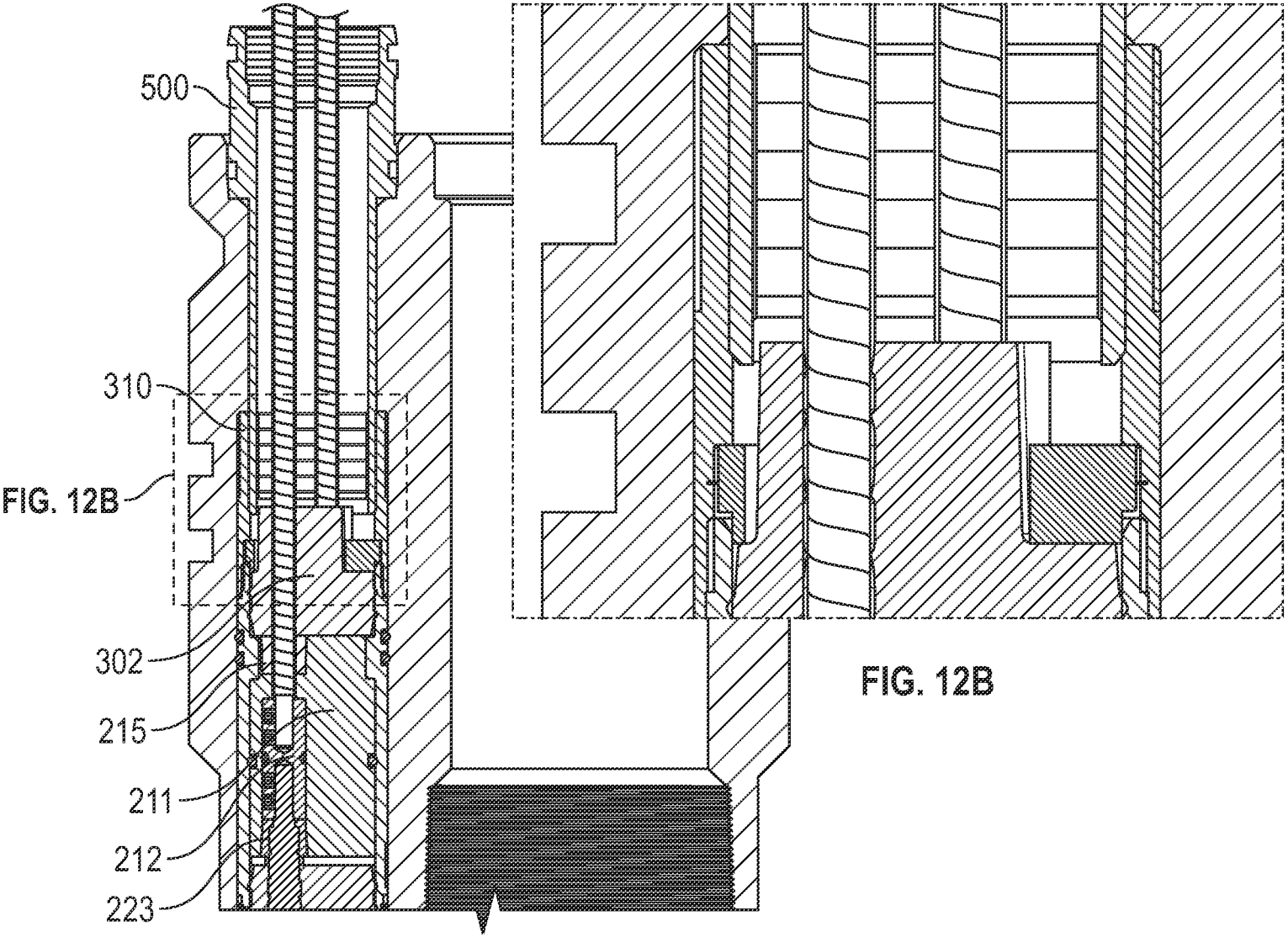
FIG. 12A depicts a cutaway side view of a tubing seal element and penetrator assembly contained in a tubing hanger in accordance with various embodiments of the present invention.
FIG. 12B depicts an exploded cutaway side view of a portion of FIG. 12A.

As an example, during a typical use, upper assembly 210 may be installed on three external power cables 214. First outer sealing element 217 is disposed on the exterior surface of upper body 211. Each external power cable 214 will be inserted through a nose sealing element 215 and into upper body 211 through to respective first female ends of each lug 212 as seen in FIG. 12. All three conductors from cables running from an ESP will be inserted through spring element 225 and primary lower sealing element 222. Primary lower sealing element 222 is configured with a receptable for each of the three conductors. Each conductor may then be passed through a respective secondary lower sealing element 223. Follower 224 may then be installed over the conductors that have been inserted through the secondary lower sealing elements. To combine upper assembly 210 and lower assembly 220, each conductor of the three ESP cables is inserted into a respective second female end of each lug 212 which are exposed beyond a lower face 218 of upper body 211. Each lug 212 has two set screws to secure the inserted conductor from an ESP cable. The two set screws may be tightened to secure each conductor. The torque applied to the set screws will dictate the amount of load that can be applied to the ESP cables before they are released from the lugs during a failure or other emergency event. Dielectric grease may be applied to secondary lower sealing elements 223, primary lower sealing element 222, and follower 224. While the base of primary lower sealing element 222 near spring element 225 is held, the upper assembly 210 may be slid toward lower assembly 220. This action will cause lugs 212 to be pushed upward and into upper body 211. Upper body 211 should come within 1.5 mm, or less, of follower 224. The upper assembly should be checked for damage and any foreign grease, dirt, or debris should be removed. Each nose sealing element 215 is then slid into upper body 211 until they are flush with an upper face 216 of upper body 211. The process of seating each nose sealing element 215 may be facilitated with the application of a small amount of dielectric grease to each nose sealing element 215. Dielectric grease is then applied to first outer sealing element 217 and the outer diameter of primary lower sealing element 222.

Figure 8:
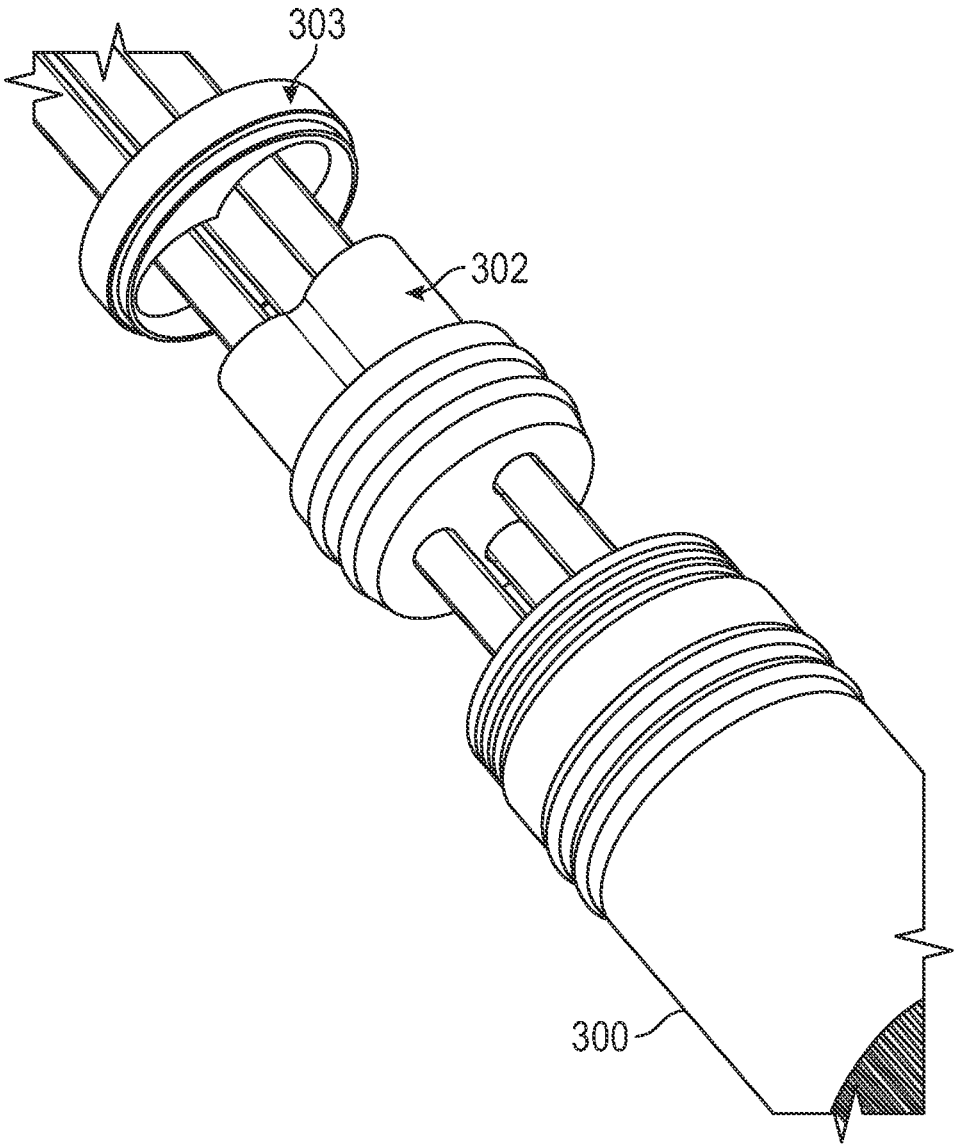
FIG. 8 depicts a perspective view of an upper penetrator cable sealing element in accordance with various embodiments of the present disclosure.
Figure 10A:
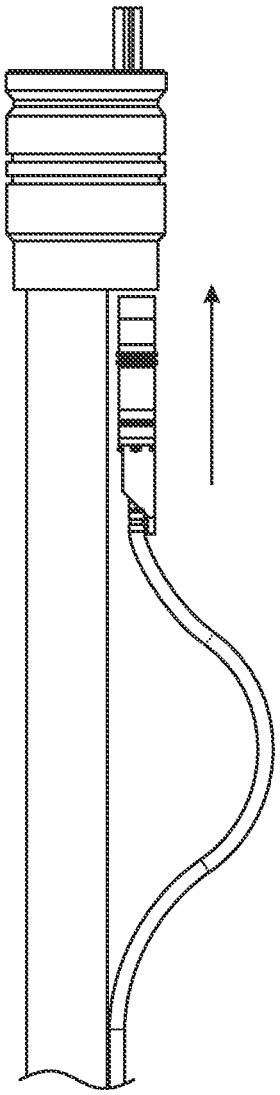
FIG. 10A depicts the installation of a penetrator assembly in accordance with various embodiments of the present disclosure.
Figure 10B:
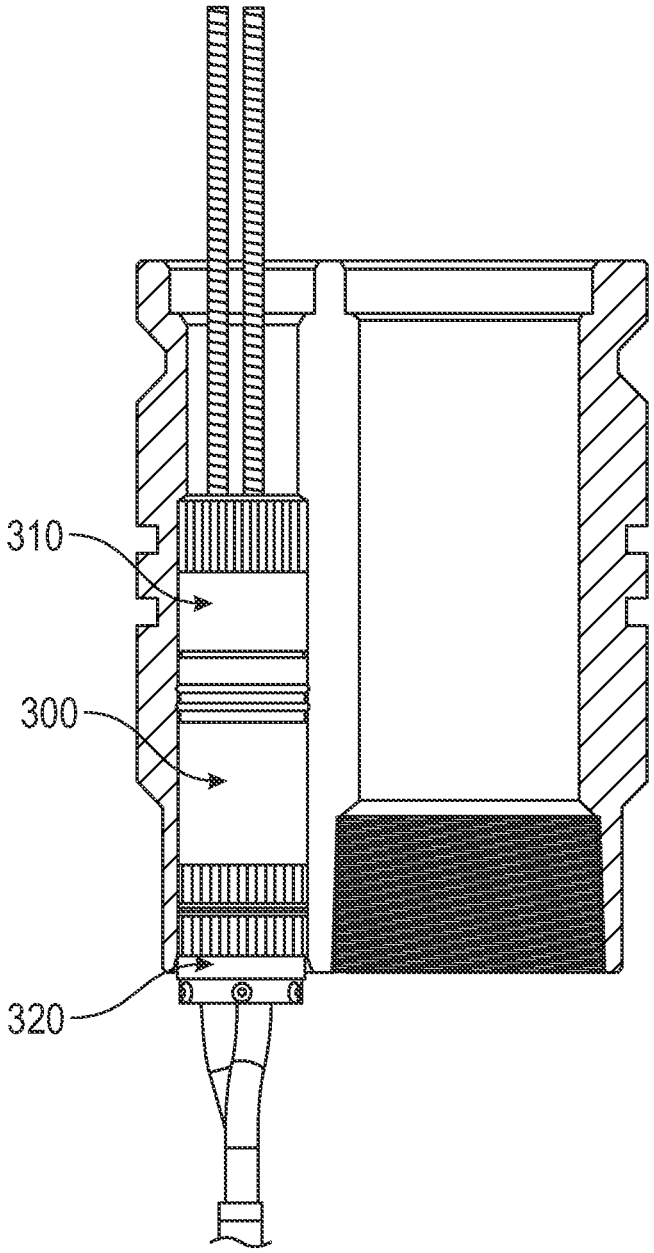
FIG. 10B depicts a penetrator assembly within a tubing hanger in accordance with various embodiments of the present disclosure.

In further embodiments, as depicted in FIG. 10, penetrator assembly 200 may further include a penetrator housing element 300, an upper penetrator cap 310, and a lower penetrator cap 320. Penetrator housing element 300 may be configured with one or more outer grooves to receive at least one second outer sealing element 301. Penetrator housing element 300 may also be configured to at least partially contain upper assembly 210 and lower assembly 220. Penetrator housing element 300 may be configured with an upper threaded portion 304 and a lower threaded portion 305. These threaded portions may be used to facilitate threaded engagement with upper penetrator cap 310 and lower penetrator cap 320. Additionally, these threaded portions may be positioned on the external surface of penetrator housing element 300. Upper penetrator cap 310 may be configured with first threaded portion 311 and a second threaded portion 312. First threaded portion 311 may be positioned on the internal surface of a first end of upper penetrator cap 310 and be configured for engagement with upper threaded portion 304 of penetrator housing element 300. Second threaded portion 312 may be positioned on the internal surface of a second end of upper penetrator cap 310. Lower penetrator cap 320 may be configured with a lower cap threaded portion 321 configured for engagement with lower threaded portion 305 of penetrator housing element 300. As shown in FIG. 8, penetrator assembly 200 may also include a primary upper sealing element 302 and upper sealing follower 303. Conductors from external power cable 214 may be passed through upper penetrator cap 310 before passing through upper sealing following 303 and upper sealing element 302. Each conductor of an external power cable may be inserted into a corresponding aperture of upper sealing element 302.

Figure 7A:
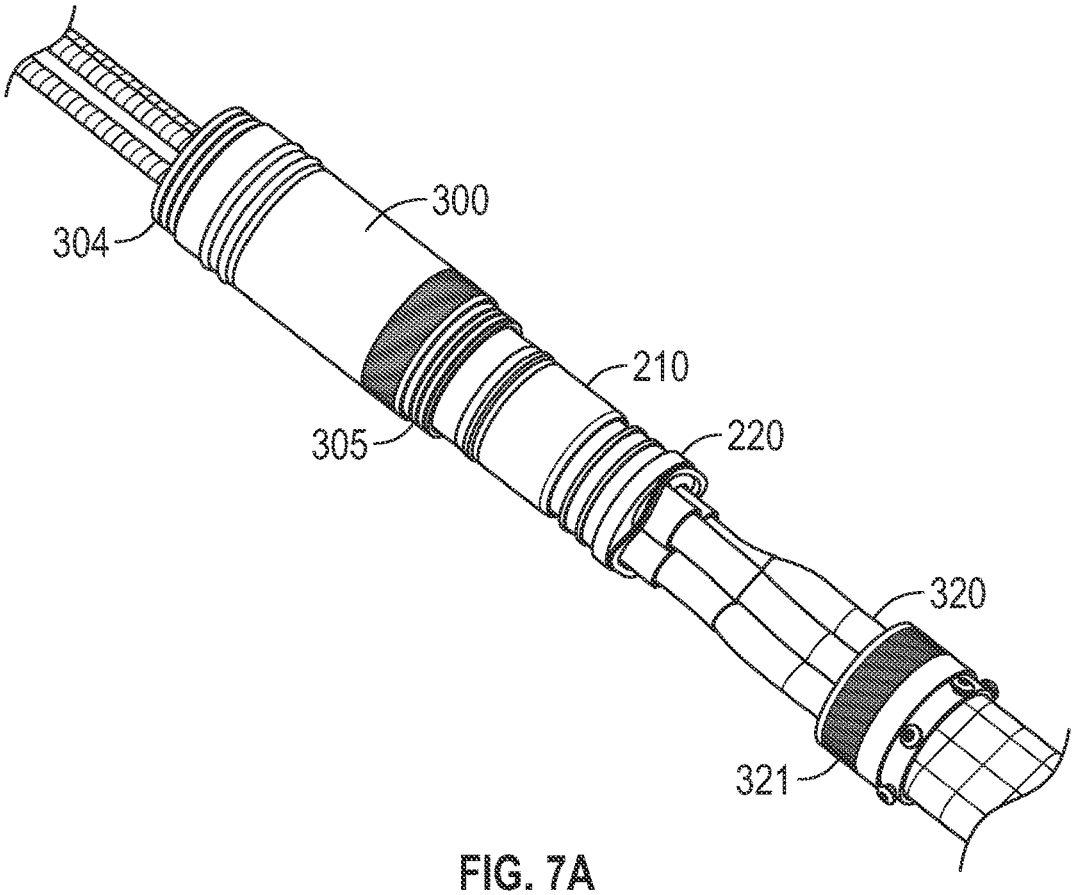
FIG. 7A depicts a perspective view of a penetrator assembly housing element in accordance with various embodiments of the present disclosure.
Figure 7B:
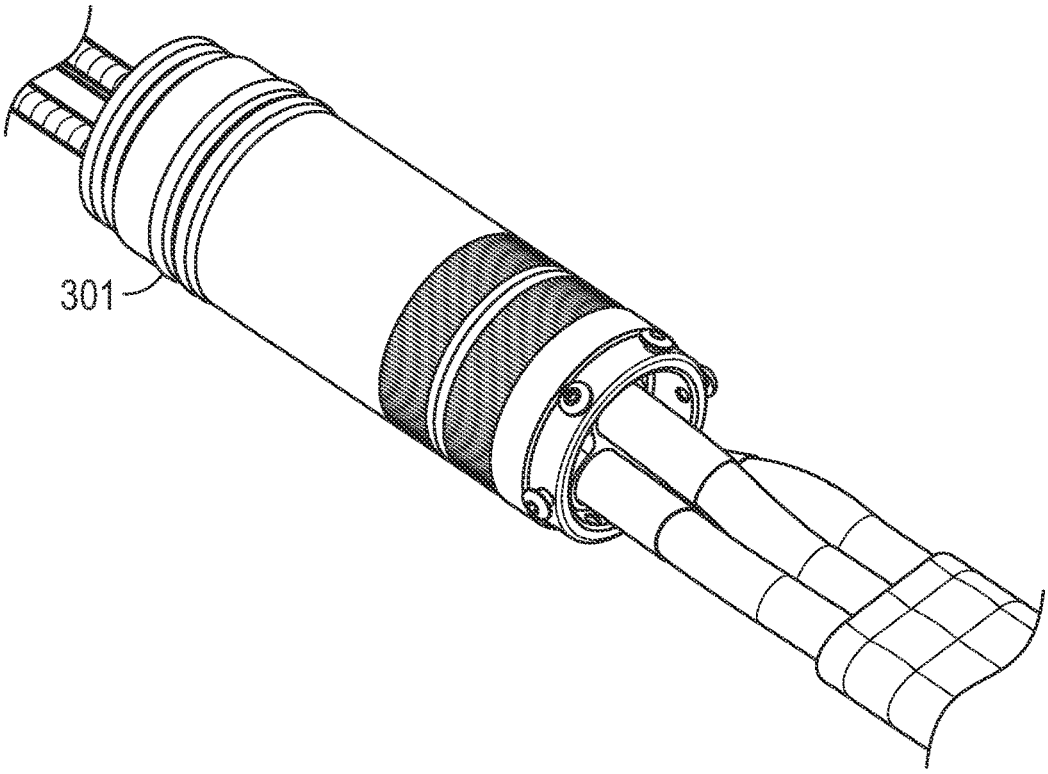
FIG. 7B depicts a perspective view of a penetrator assembly housing element having an engaged lower cap in accordance with various embodiments of the present disclosure.
Figure 9:
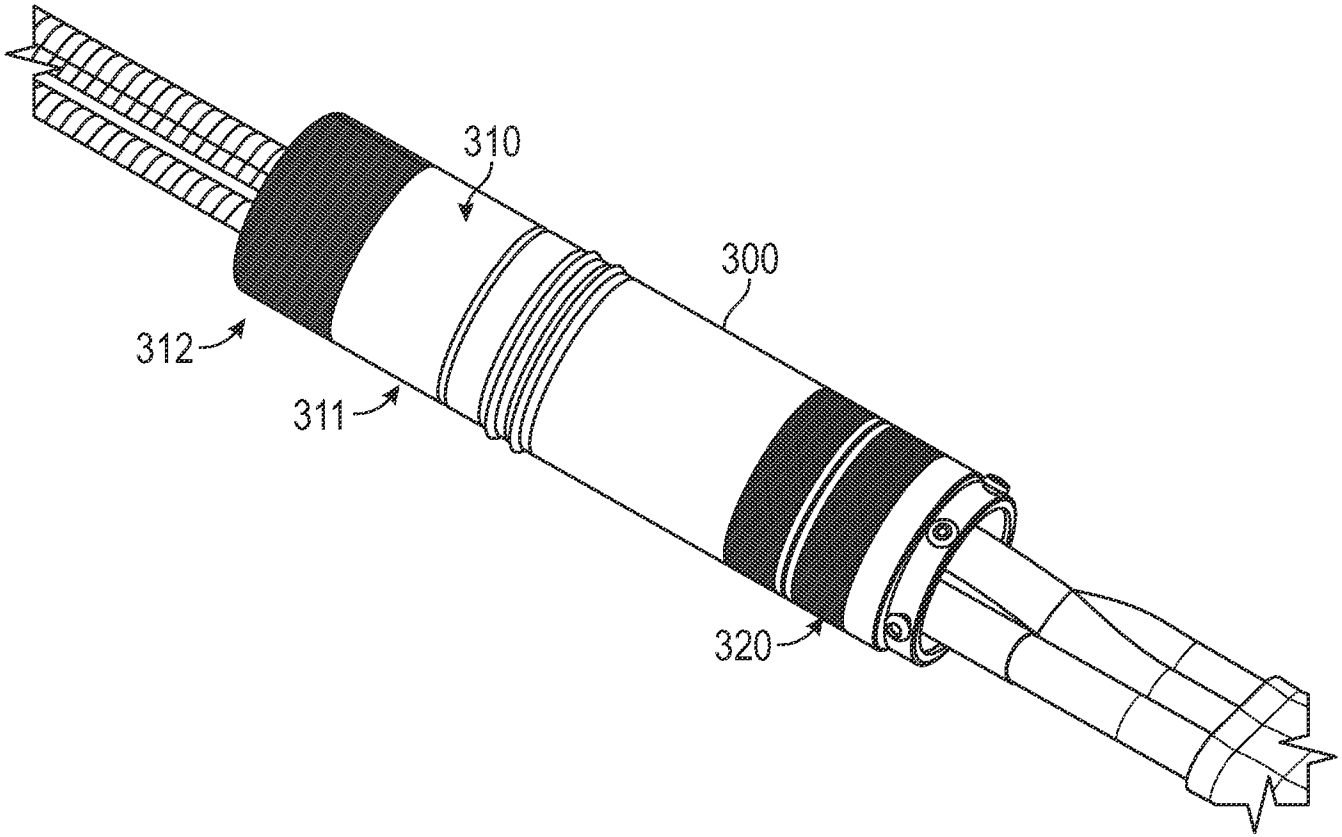
FIG. 9 depicts a perspective view of a penetrator assembly upper end cap in accordance with various embodiments of the present disclosure.

Returning to the exemplary use scenario set out above, the additional components of an embodiment of the present disclosure can be incorporated as follows. A penetrator housing element 300, which the external power cables may have been passed through before passing through upper assembly 210 and having two installed secondary outer sealing elements, may then be slid down and onto upper assembly 210. This can be achieved by holding primary lower sealing element 222 and sliding penetrator housing element 300 over upper assembly 210. Penetrator housing element 300 should continue to slide down until it substantially contains both upper assembly 210 and lower assembly 220. As depicted in FIG. 7, primary lower sealing element 222 may have ridges on its exterior surface. When installed over lower assembly 220, there should be minimal distance, if any, between the interior surface of penetrator housing element 300 and these ridges. These ridges will serve to minimize any potential fluid flow that may occur in a downhole failure. Lower penetrator cap 320, which the ESP cables may have been passed through before passing through lower assembly 220, may then be threaded onto lower threaded portion 305 of penetrator housing element 300. Shown in FIG. 8, upper sealing element 302 and upper sealing follower 303, which may also have had the external power cables passed through before including the penetrator housing element 300 and upper assembly 210, may then be installed into penetrator housing element 300. Upper sealing element 302 resembles primary lower sealing element 222 in structure but is oriented in the opposite direction. Dielectric grease may be applied to the outer diameter of upper sealing element 302. Upper sealing element 302 is slide down along the external power cables and into penetrator housing element 300 until it is flush against the upper face 216 of upper body 211. In such a position, the outer ridges depicted on upper sealing element 302 should be contained within penetrator housing element 300 with minimal, if any distance, between the interior surface of penetrator housing element 300 and the ridges. Upper sealing follower 303 is then slide downward and into penetrator housing element 300. Upper sealing following 303 may be configured with a shoulder such that, when installed into penetrator housing element 300, it is not fully inserted into penetrator housing element 300 but is rather supporting by an upper annular surface of penetrator housing 300 while leaving upper threaded portion 304 unobscured and capable of engagement with upper penetrator cap 310. Upper penetrator cap, which may have had the external power cables passed through before passing them through upper sealing element 302 and upper sealing follower 303, is then slide down the external power cables and threaded onto penetrator housing element 300 via upper threaded portion 304 and first threaded portion 311 as shown in FIG. 9. Once penetrator assembly 200 is assembled, it can then be installed into the bottom of the feed-thru port within tubing hanger 100 until it shoulders out on an internal edge of tubing hanger 100 as depicted in FIG. 10.

Figure 13:
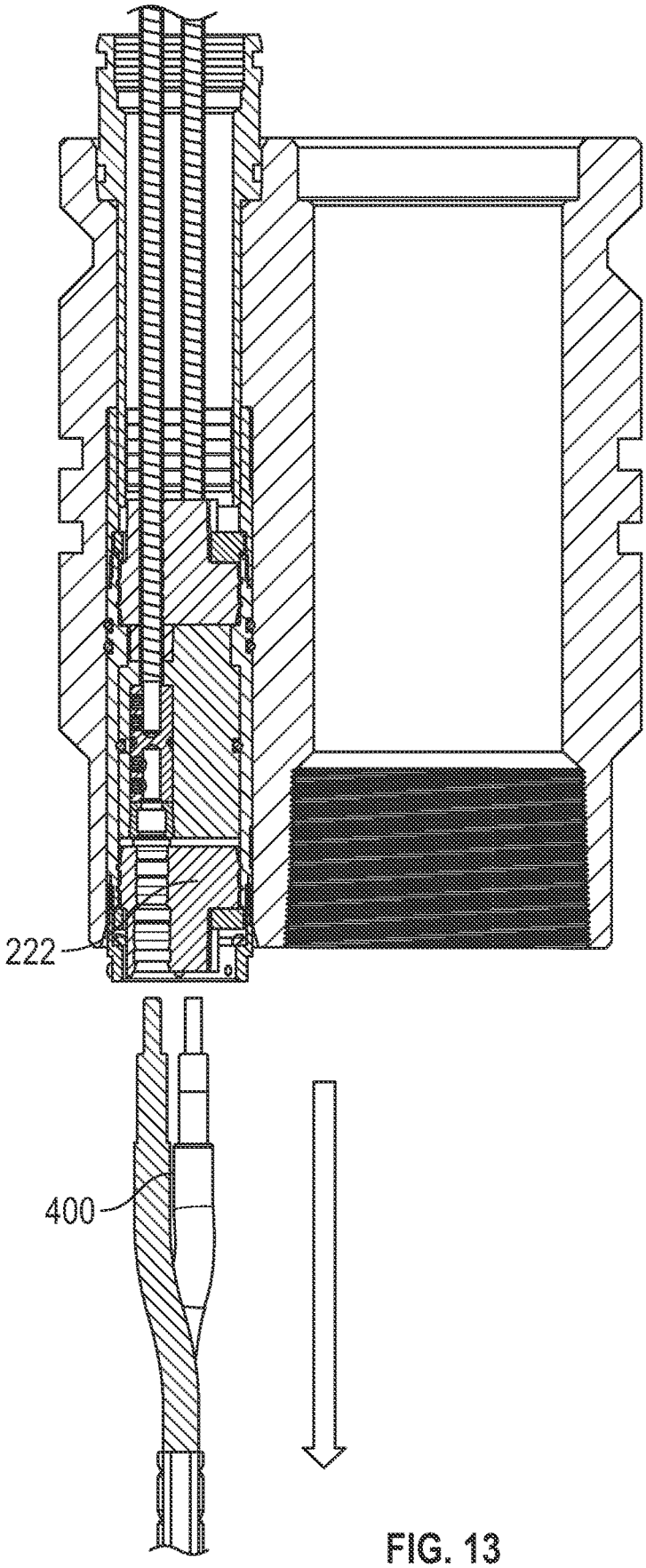
FIG. 13 depicts a cutaway side view of a tubing seal element and penetrator assembly contained in a tubing hanger during a breakaway event in accordance with various embodiments of the present disclosure.

Although conductor retention elements 213 already provide for improved performance in the event of a tubing part or other downhole failure by allowing the ESP cables to disengage with the penetrator assembly at the bottom of the tubing hanger thereby preventing fluid and pressure from escaping into the wellhead, as shown in FIG. 13, additional embodiments of the present disclosure include a retention assembly to enhance this performance and provide further safety benefits. In such embodiments, an improved wellhead electrical connection assembly includes a retention assembly 500 in addition to penetrator assembly 200.

Figure 11A:
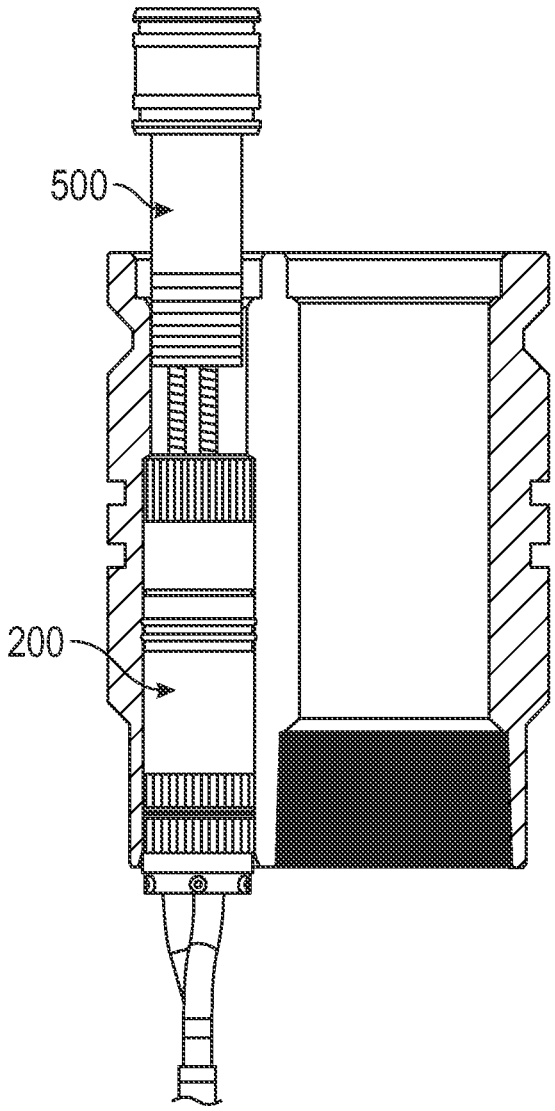
FIG. 11A depicts a cutaway side view of a tubing hanger with a tubing seal element and penetrator assembly contained therein in accordance with various embodiments of the present invention.
Figure 11B:
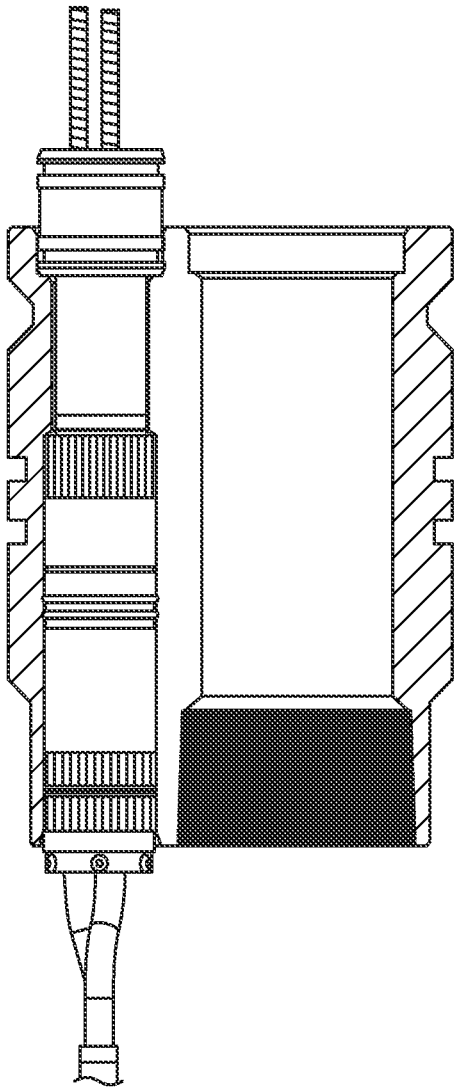
FIG. 11B depicts a cutaway side view of a tubing hanger with a tubing seal element and engaged penetrator assembly contained therein in accordance with various embodiments of the present invention.

As illustrated in FIG. 11, retention assembly 500 is shaped to fit within tubing hanger 100. Retention assembly 500 may be substantially cylindrical in shape and have a shoulder element that has larger outer diameter than the main body portion of retention assembly 500. Additionally, retention assembly 500 may have a threaded retention portion that is configured to engage with second threaded portion 312 of upper penetrator cap 310.

To install retention assembly 500, external power cables 214 may be passed through retention assembly 500 before installation of penetrator assembly 200. After installation of penetrator assembly 200 and insertion of penetrator assembly 200 into tubing hanger 100, retention assembly 500 may be slid into the upper portion of tubing hanger 100 and engaged to penetrator assembly 200 via the threaded retention portion of retention assembly 500 and second threaded portion 312 of upper penetrator cap 310. As seen in FIG. 12, the engagement of retention assembly 500 to penetrator assembly 200 secures retention assembly 200 within tubing hanger 100. The shoulder element and threaded engagement will prevent the assemblies from being pulled downhole in the event of a tubing part or other failure.

Figure 15B:
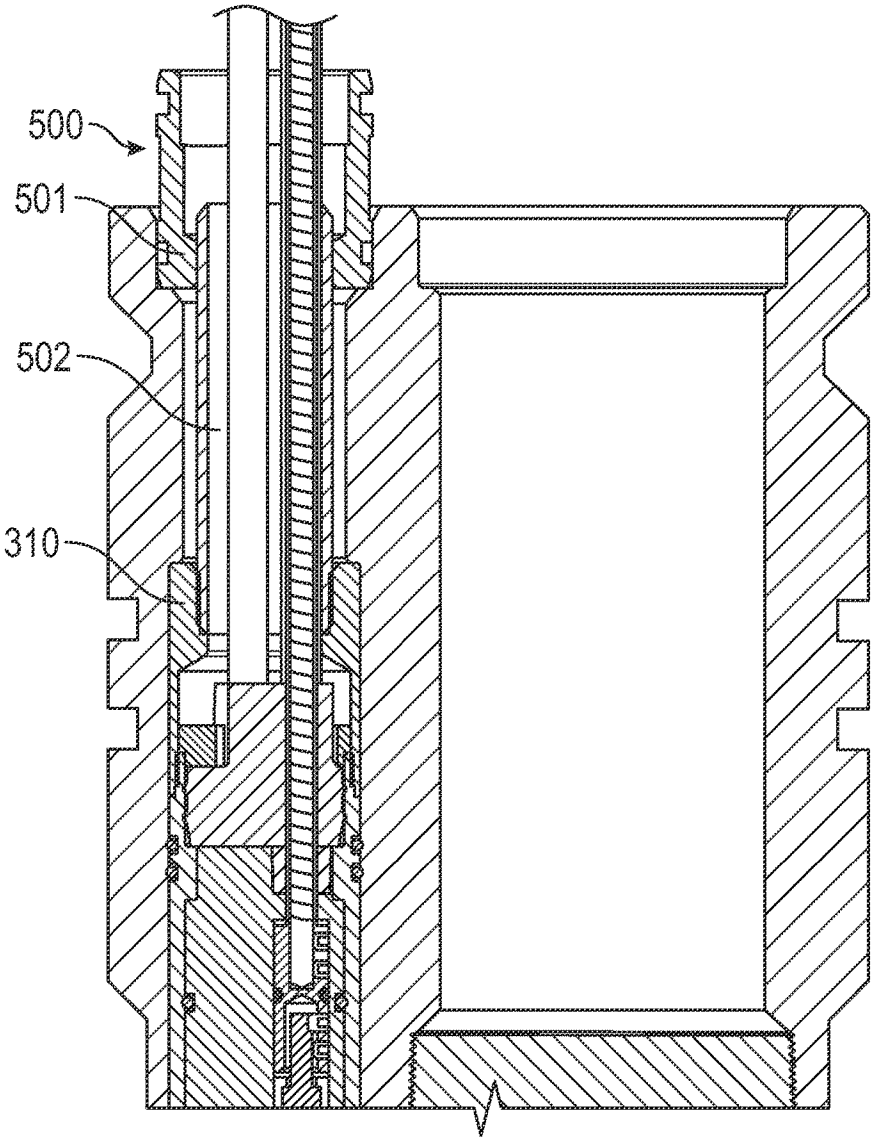
FIG. 15B depicts a cutaway side view of a tubing seal element in a tubing hanger having a retention assembly in accordance with other embodiments of the present disclosure.
Figure 15A:
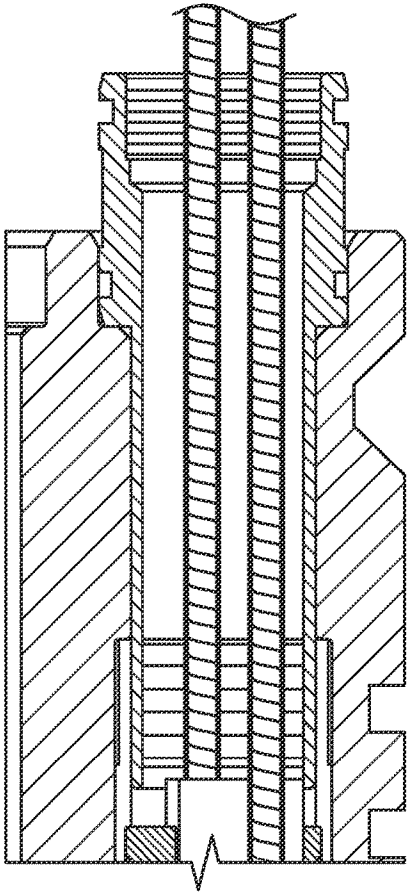
FIG. 15A depicts a cutaway side view of a tubing seal element in a tubing hanger having a retention assembly in accordance with various embodiments of the present disclosure.

An alternative configuration of retention assembly 500 can be seen in FIG. 15. While the previously described embodiments have had retention assembly 500 composed of a single structural element, retention assembly 500 in other embodiments may include a separate top locking element 501 and connector element 502. Connector element 502 may be a tube having a first connector threaded portion and a second connector threaded portion. Each threaded portion may be disposed on the exterior surface of the tube on opposite ends. This configuration allows for connector element 502 to engage with second threaded portion 312 of upper penetrator cap 310. Top locking element 501 may have an outer diameter that is larger than that of connector element 502. Top locking element 501 may also have an internal shoulder threaded portion. Top locking element 501 may then engage with connector element 502 via their respective threaded portions. The greater outer diameter of top locking element 501 allows for top locking element 501 to be secured in tubing hanger 100 as depicted in FIG. 15. By having top locking element 501 and connector element 502 as separate pieces, a user can maintain several connector elements 502 of varying sizes to accommodate different tubing hanger dimensions or project requirements while utilizing the same top locking element 501 component. This provides both the improved retention features of retention assembly 500 and greater flexibility.

Figure 16:
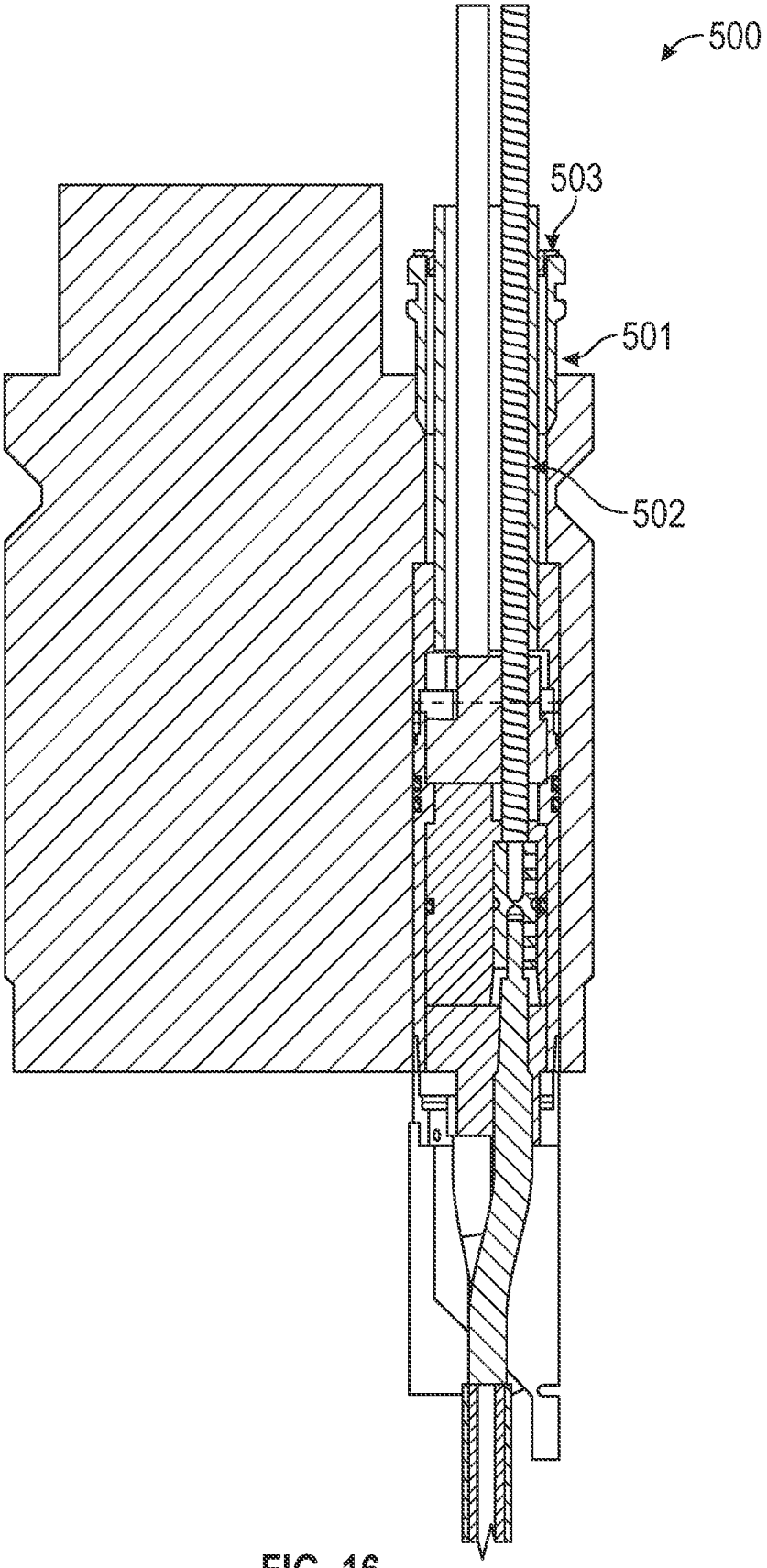
FIG. 16 depicts a cutaway side view of a tubing seal element in a tubing hanger in accordance with various embodiments of the present disclosure.

A further alternative configuration of retention assembly 500 can be seen in FIG. 16. In this configuration, top locking element 501 may not include an internal shoulder threaded portion. In some cases, top locking element 501 may included an exterior threaded portion for threaded engagement with the tubing hanger. Connector element 502, as above, may be a substantially cylindrical body (such as a tube) and have exterior threaded portions on its ends. Connector element 502 may be configured for threaded engagement with upper penetrator cap 310 similar to the previously described configuration. To provide secured retention of connector element 502 with top locking element 501, a top retention element 503 may be utilized. Top retention element 503 may define an aperture for receiving connector element 502, the aperture having an internal threaded portion configured to engage with a corresponding threaded portion of connector element 502. Top retention element 503 may further include a top shoulder retention portion, extending radially outward from the aperture, that is configured to rest against an upper face of top locking element 501. Top retention element would thereby inhibit downward motion of connector element 502 when connector element 502 is engaged to top retention element 503 and top retention element 503 is seated against top locking element 501. As shown in FIG. 16, top retention element 503 may be a nut or other structure capable of engaging with connector element 502 and top locking element 501.

Figure 14B:
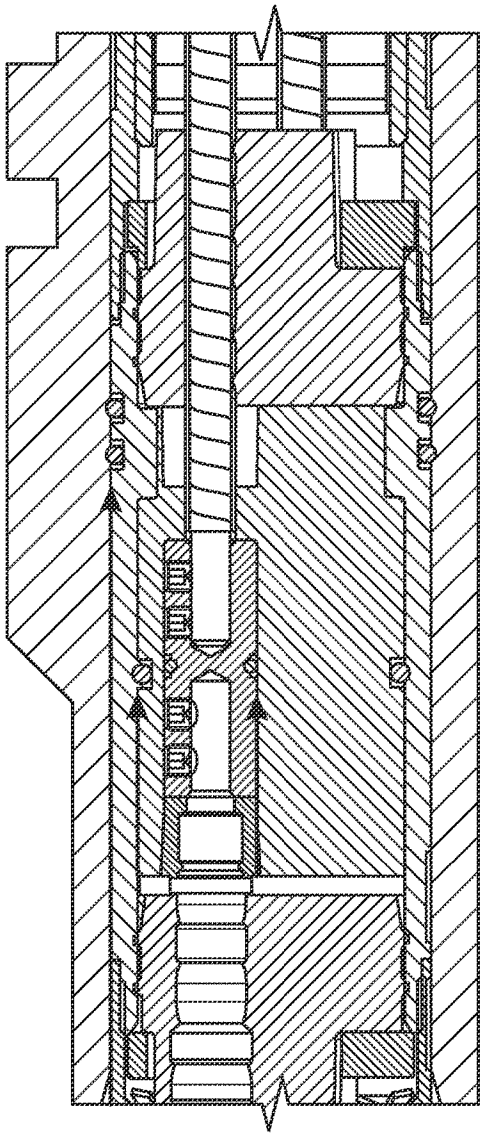
FIG. 14B depicts a cutaway side view of the paths of potential fluid travel in accordance with various embodiments of the present invention.
Figure 14A:
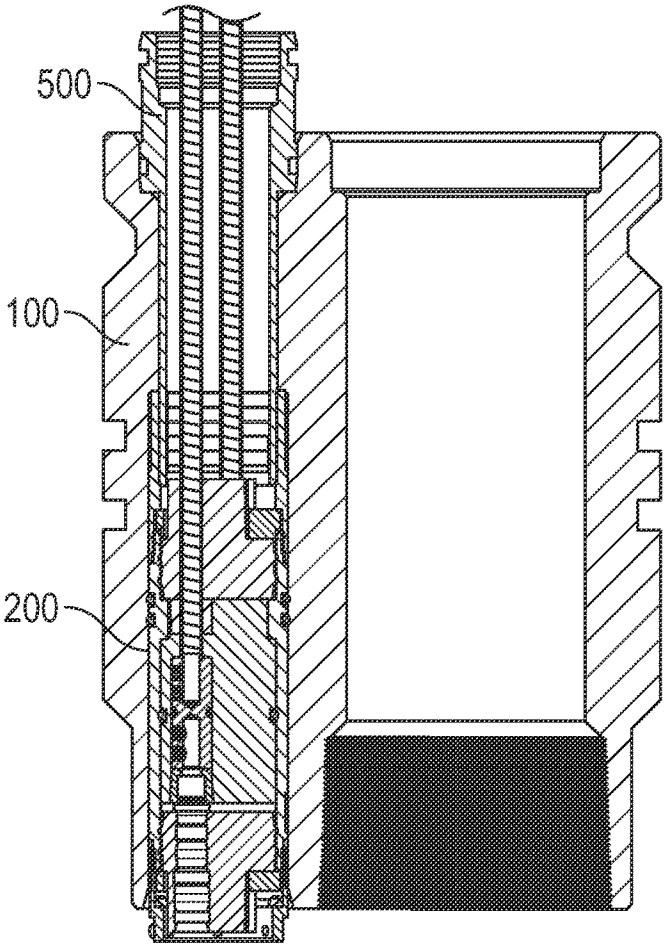
FIG. 14A depicts a cutaway side view of a penetrator assembly installed in a tubing hanger in accordance with various embodiments of the present invention.

As depicted in FIG. 14, in an event during which the ESP cables are broken away from penetrator assembly 200, the improved wellhead electrical connection assembly remains in place and the potential paths of fluid entry are blocked by the assembly's seals. As a result, there are no concerns of fluid exposure to workover personal as an adapter is removed (if applicable) and a blowout preventer (BOP) is installed because wellbore fluids are contained below the tubing hanger. Well control is maintained during these activities because of the sealing mechanisms set by penetrator assembly 200 and retention assembly 500 within the tubing hanger.

The invention claimed is:

1. A wellhead electrical connector assembly comprising:
- a substantially cylindrical outer housing body, said outer housing body being configured to substantially contain a first retention assembly, wherein said first retention assembly comprises:
  - a substantially cylindrical inner housing body:
  - at least one conductor receptacle, said at least one conductor receptacle being configured to engage with one or more cable conductors, said at least one conductor receptacle being further configured to securely engage with at least one of said one or more cable conductors;
- an upper assembly cap configured to engage with a first end of said outer housing body;
- an upper retention body configured to be securely contained within a tubing hanger;
- a connector body configured to engage with said upper assembly cap; and
- a retention connector configured to engage with said connector body, said retention connector having a shoulder portion configured to engage with said upper retention body.

2. The wellhead electrical connector assembly of claim 1 wherein said outer housing body has a first threaded outer housing section, wherein said upper assembly cap has a first threaded inner cap section, said first threaded outer housing section and said first threaded inner cap are configured for threaded engagement with one another.

3. The wellhead electrical connector assembly of claim 1 further comprising a lower assembly cap configured to engage with a second end of said outer housing body.

4. The wellhead electrical connector assembly of claim 3 further comprising a second retention assembly comprising a primary lower sealing element configured to couple to said one or more cable conductors, wherein said outer housing body is further configured to substantially contain said second retention assembly when said lower assembly cap is engaged to said second end of said outer housing body.

5. The wellhead electrical connector assembly of claim 1 wherein said at least one conductor receptacle comprises one or more conductor retention elements adapted to a reversible engagement between said at least one conductor receptacle and said one or more cable connectors.

6. The wellhead electrical connector assembly of claim 5 wherein said one or more conductor retention elements is at least one set screw.

7. The wellhead electrical connector assembly of claim 6 wherein said at least one set screw is flat-headed.

* * * * *